US008087125B2

(12) United States Patent
Wu et al.

(10) Patent No.: US 8,087,125 B2
(45) Date of Patent: Jan. 3, 2012

(54) SUCTION HEAD STRUCTURE AND VACUUM CLEANER USING THE SAME

(75) Inventors: Sheng Wu, Shenzhen (CN); Jin-Shan Cui, Shenzhen (CN); San-Yan Zhang, Shenzhen (CN)

(73) Assignees: Shenzhen Futaihong Precision Industry Co., Ltd., Shenzhen, Guangdong Province (CN); FIH (Hong Kong) Limited, Kowloon (HK)

( * ) Notice: Subject to any disclaimer, the term of this patent is extended or adjusted under 35 U.S.C. 154(b) by 1047 days.

(21) Appl. No.: 11/961,278

(22) Filed: Dec. 20, 2007

(65) Prior Publication Data

US 2009/0064444 A1 Mar. 12, 2009

(30) Foreign Application Priority Data

Sep. 7, 2007 (CN) ..... 2007 1 0077023

(51) Int. Cl.
*A47L 9/06* (2006.01)

(52) U.S. Cl. ..... 15/416; 15/397; 15/419; 15/421

(58) Field of Classification Search ..... 15/397, 15/416, 419, 421; *A47L 9/06*
See application file for complete search history.

(56) References Cited

U.S. PATENT DOCUMENTS

| | | | | |
|---|---|---|---|---|
| 2,176,139 | A * | 10/1939 | Lofgren | 251/145 |
| 2,276,944 | A * | 3/1942 | Dow | 15/397 |
| 2,590,527 | A * | 3/1952 | Fluck | 601/7 |
| 6,484,357 | B1 * | 11/2002 | Dong | 15/397 |

FOREIGN PATENT DOCUMENTS

| | | |
|---|---|---|
| JP | 52-55664 U | 4/1977 |
| JP | 7-23881 A | 1/1995 |

* cited by examiner

*Primary Examiner* — David Redding
(74) *Attorney, Agent, or Firm* — Altis Law Group, Inc.

(57) ABSTRACT

A suction head structure (10) and a vacuum cleaner (20) using the same for adsorbing grains is provided. The suction head structure includes an accommodating room (14), a plurality of suction tubes (11), an eject tube (12), and an air inlet (13). The accommodating room is configured for accommodating grains therein. The suction tubes connect with the accommodating room. Each of the plurality of suction tubes is configured for adsorbing grain into the accommodating room. The eject tube connects with the accommodating room. The eject tube is configured for ejecting grains accommodated in the accommodating room. The air inlet connects with the eject tube. The air inlet is configured for injecting cool air into the eject tube.

17 Claims, 3 Drawing Sheets

SUCTION HEAD STRUCTURE AND VACUUM CLEANER USING THE SAME

BACKGROUND OF THE INVENTION

1. Field of the Invention

The present invention relates to suction head structures and vacuum cleaners, particularly to a suction head structure used in a vacuum cleaner.

2. Description of Related Art

Vacuum cleaner is usually used to adsorb/clean grains (e.g., sand grains, dust, waste materials, or the like) during process of manufacturing electronic products. The vacuum cleaner typically includes an accommodating room, a suction head structure, and a suction hood. The suction head structure connects with the vacuum cleaner and the accommodating room. The grains are adsorbed from the suction hood and suction head structure into the accommodating room as the vacuum cleaner is operated.

However, the typical vacuum cleaner may be operated one time to solely adsorb particular grains. The adsorbed grains are located at a particular position. Other grains located at other positions can be adsorbed by additionally adjusting and operating the vacuum cleaner to the desired position. Furthermore, airflow of the typical vacuum cleaner is relatively weak. The adsorbed grains tend to block tubes/tubes of the suction head structure and the suction hood. Moreover, frictional heat, generated by interactions between the adsorbed grains and the tubes, tends to conduct to a driving motor of the vacuum cleaner, which shortens usage life of the driving motor.

Therefore, a heretofore-unaddressed need exists in the art to address the aforementioned deficiencies and inadequacies.

SUMMARY

In present aspect, a suction head structure used for adsorbing grains is provided. The suction head structure includes an accommodating room, a plurality of suction tubes, an eject tube, and an air inlet. The accommodating room is configured for accommodating grains therein. The suction tubes communicate with the accommodating room. Each of the plurality of suction tubes is configured for adsorbing grain into the accommodating room. The eject tube communicates with the accommodating room. The eject tube is configured for facilitating ejecting grains accommodated in the accommodating room. The air inlet connects with the eject tube. The air inlet is configured for facilitating injecting cool air into the eject tube.

In another aspect, a vacuum cleaner using the present suction head structure for adsorbing grains is provided. The vacuum cleaner includes a plurality of suction hoods. The suction hoods respectively correspond and communicate with suction tubes.

These and other aspects of the present invention will become more apparent from the following detailed description of the preferred embodiments taken in conjunction with the accompanying drawings, although variations and modifications therein may be affected without departing from the spirit and scope of the novel concepts of the disclosure.

BRIEF DESCRIPTION OF THE DRAWINGS

Many aspects of the present suction head structure and the vacuum cleaner using the suction head structure can be better understood with reference to the following drawings. These drawings are not necessarily drawn to scale, the emphasis instead being placed upon clearly illustrating the principles of the present suction head structure and the vacuum cleaner using the suction head structure. Moreover, in the drawings like reference numerals designate corresponding parts throughout the several views. Wherever possible, the same reference numbers are used throughout the drawings to refer to the same or like elements of an embodiment.

DETAILED DESCRIPTION OF THE EMBODIMENTS

Figure 1:
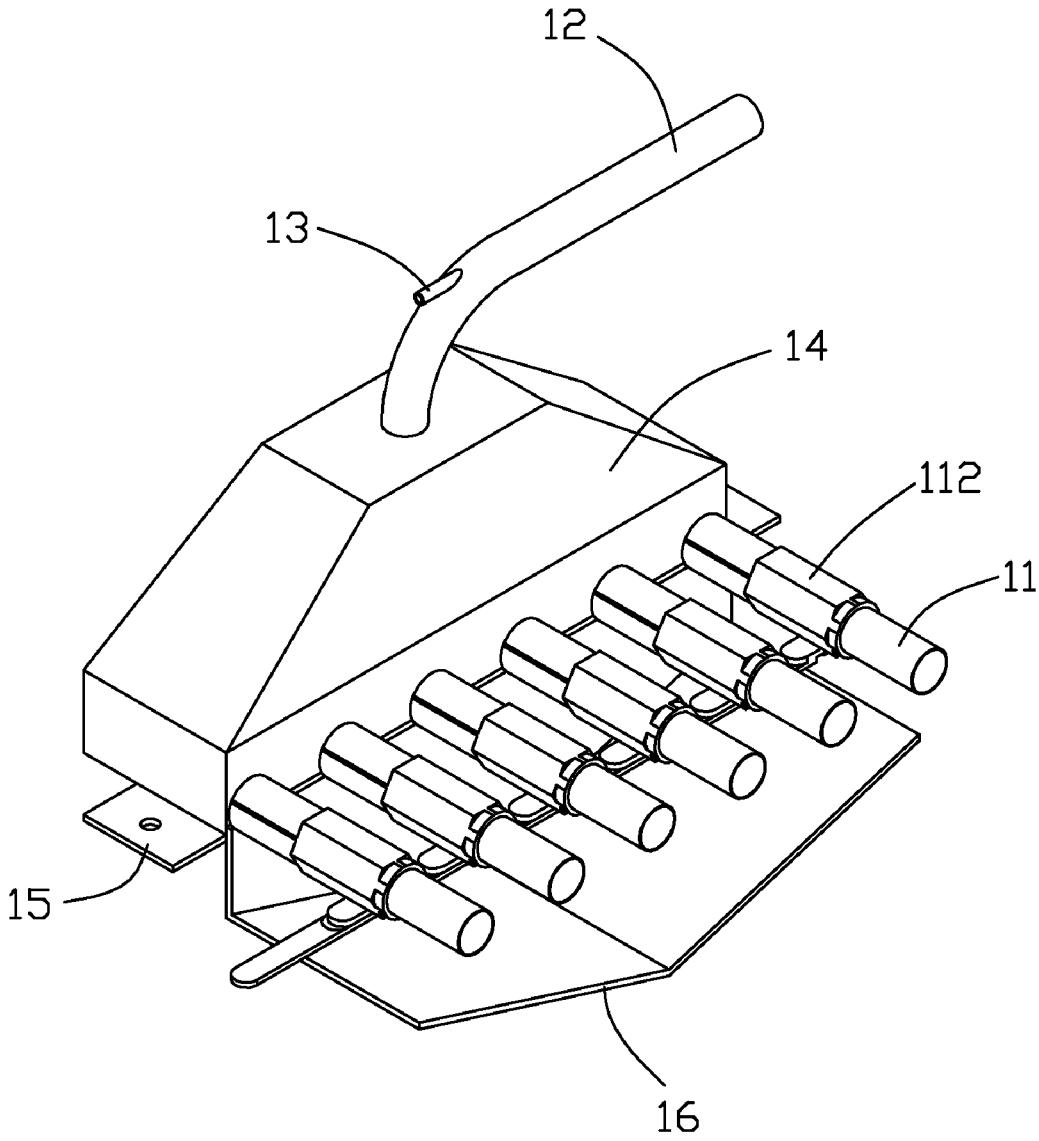
FIG. 1 is an isometric, assembled view of a suction head structure in accordance with a present embodiment.
Figure 2:
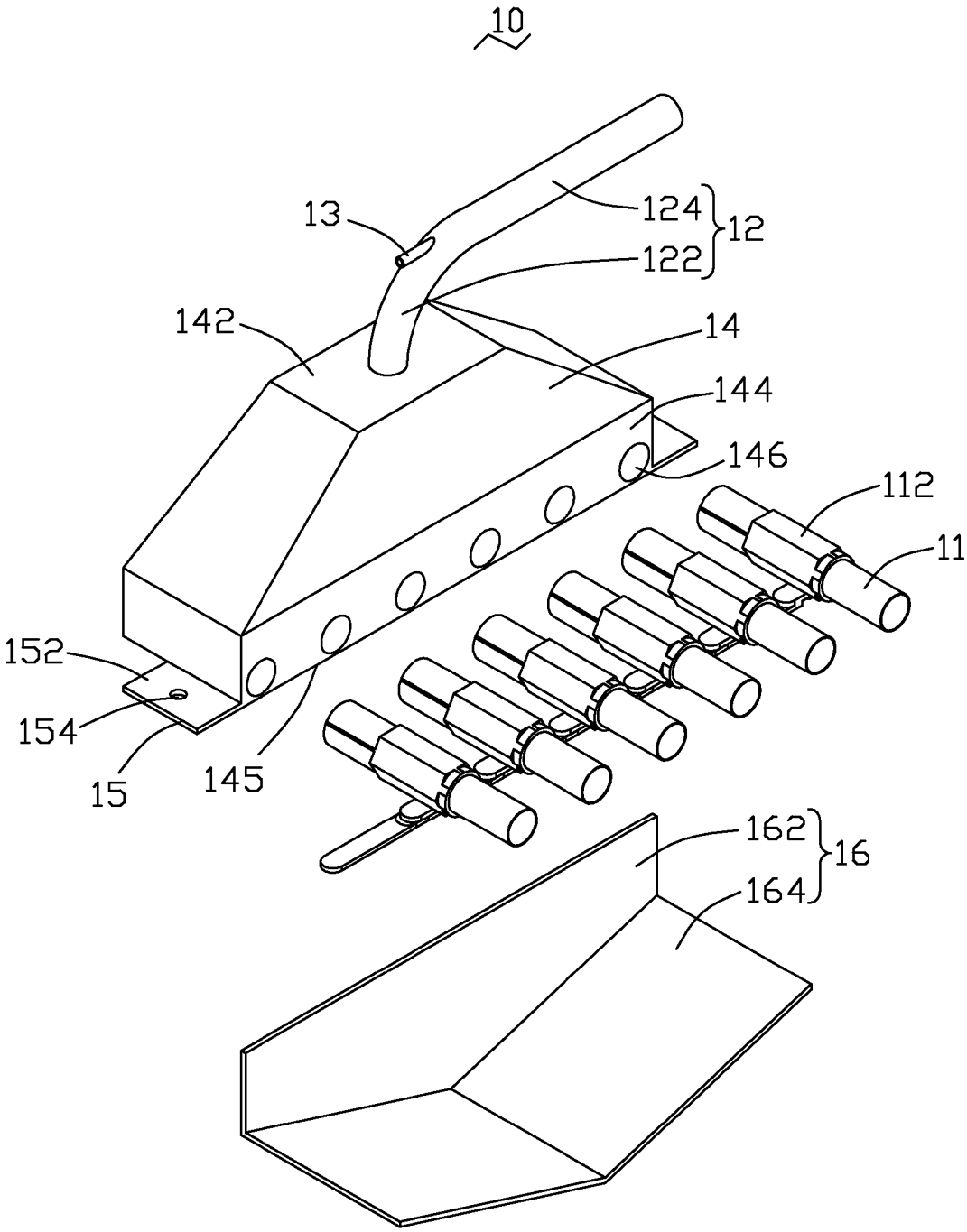
FIG. 2 is an exploded, isometric view of the suction head structure shown in FIG. 1.
Figure 3:
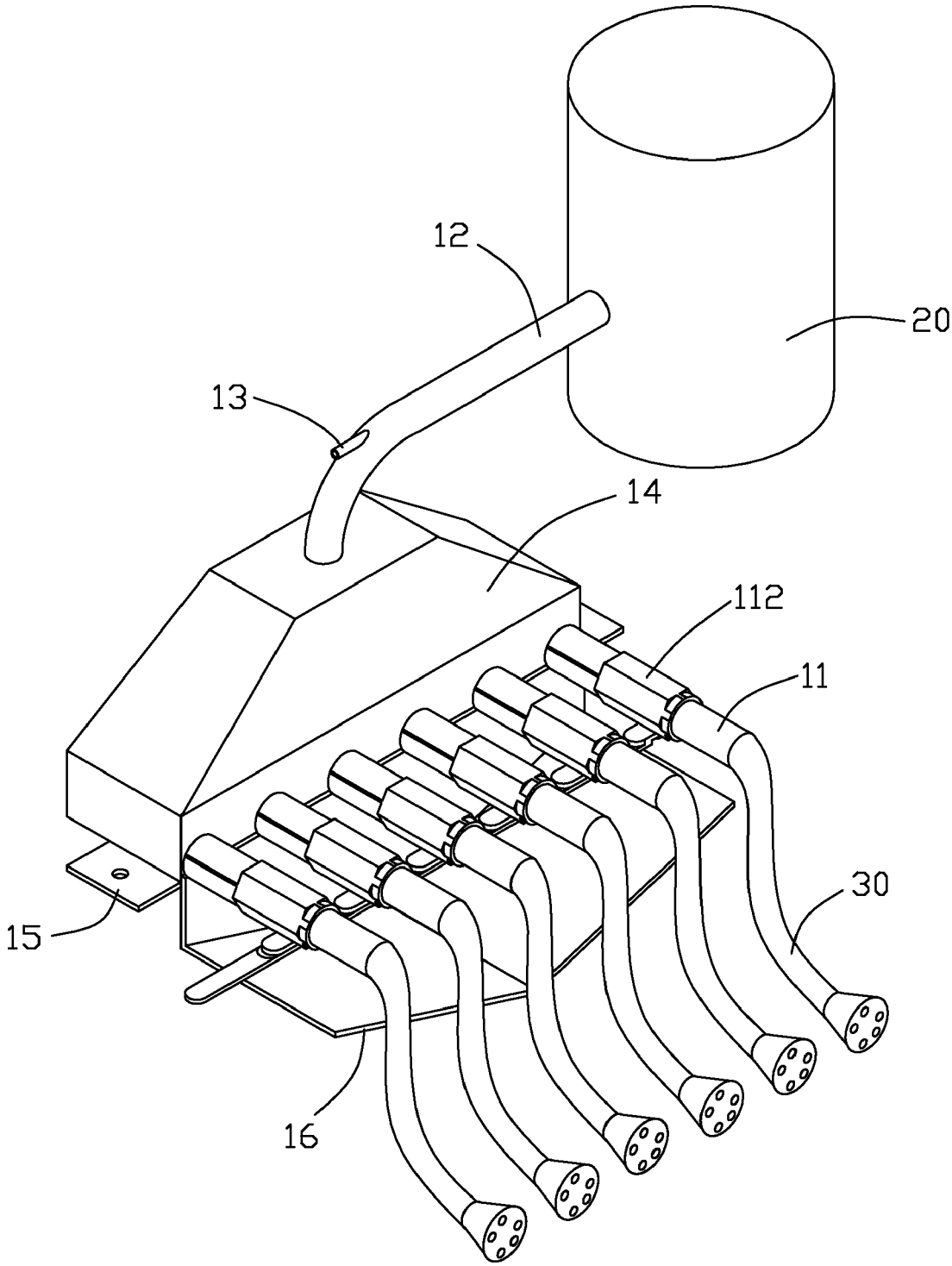
FIG. 3 is an isometric view of a vacuum cleaner using the suction head structure shown in FIG. 1.

The present suction head structure and the vacuum cleaner using the suction head structure is described here in conjunction with the accompanying drawings in FIGS. 1 through 3. The suction head structure is suitably assembled in a vacuum cleaner for adsorbing/cleaning grains (e.g., sand grains, dust, waste materials, or the like) during process of manufacturing electronic products (e.g., mobile phones, personal digital handsets, or the like).

Referring to FIG. 1, the suction head structure 10 includes a plurality of suction tubes 11, an eject tube 12, an air inlet 13, an accommodating room 14, and a fixing board 15. The suction tubes 11 are used to adsorb grains and connect/communicate with one end of the accommodating room 14. Thus, the adsorbed grains can be accommodated and received in the accommodating room 14 via the suction tubes 11. The eject tube 12 communicates with another end of the accommodating room 14 and facilitates ejecting the adsorbed grains from the accommodating room 14 to a waste bin (not shown) of a vacuum cleaner 20 (shown in FIG. 3). The air inlet 13 communicates with the eject tube 12 and an air supply (not shown), which is used to facilitate injecting cool air from the air supply through the eject tube 12 to the vacuum cleaner 20.

Referring further to FIGS. 2 and 3 in detail, each of the plurality of suction tubes 11 is a straight tube respectively structured and arranged in parallel with each other. Each suction tube 11 has two opposite ends, one end of each suction tube 11 communicates with the accommodating room 14 while the other end communicates with a suction hood 30. Each suction hood 30 corresponds to respective suction tube 11, both of which are configured (e.g., structured/arranged) for adsorbing grains during process of manufacturing electronic products. Each suction tube 11 has a switch 112 (e.g., ball valve switch) disposed/formed/assembled thereon and configured for blocking or releasing of the suction tube 11.

The eject tube 12 is generally a J-shaped tube and includes a curve tube 122 and a straight tube 124. The curve tube 122 directly communicates with the straight tube 124 and the accommodating room 14, both of which are integrally formed as a whole. The straight tube 124 further directly connects with the vacuum cleaner 20. The vacuum cleaner 20 can be operated to adsorb the grains from the suction hoods 30 and the suction tubes 11 into the accommodating room 14, then to eject the adsorbed grains from the accommodating room 14 through the eject tube 12 to the waste bin of the vacuum cleaner 20.

The air inlet 13 is advantageously disposed on a connecting portion (not labeled) of the curve tube 122 and the straight tube 124 and linearly connects with the straight tube 124.

Thus, as the air inlet 13 communicated with an air supply, airflow of the injected cool air through the straight tube 124 is increased.

The accommodating room 14 is generally a hollow three-dimensional trapezoid and includes an upper wall 142, four sidewalls 144, and a lower wall 145. The lower wall 145 is located on the opposite side of the upper wall 142. The upper wall 142 defines a connecting hole (not labeled) therethrough. The connecting hole advantageously has essentially the same shape and size as that of the curve tube 122 of the eject tube 12. The upper wall 142 is configured for fixing (e.g., weld) the eject tube 12 thereon. As such, the connecting hole is configured for communicating with the curve tube 122.

One of the four sidewalls 144 has a plurality of through holes 146 defined therethrough. The through holes 146 are advantageously arranged on a line and respectively correspond to the suction tubes 11 and further located adjacent the lower wall 145. Each of the through holes 146 advantageously has essentially the same shape and size as that of corresponding suction tube 11. The sidewall 144 is configured for fixing (e.g., weld) the suction tubes 11 thereon. As such, the through holes 146 are respectively configured for communicating with the suction tubes 11.

The fixing board 15 is generally rectangular and fixed (e.g., welded) to the lower wall 145 of the accommodating room 14. The fixing board 15 has two fixing portions 152 adversely extended from the lower wall 145. Each of the two fixing portions 152 has a fixing hole 154 defined therethrough. The fixing holes 154 combined with a fixing member (e.g., screw) facilitate fixing (e.g., screwing) the suction head structure 10 to a base (not shown, e.g., a base of the vacuum cleaner 20).

The suction head structure 10 further includes a supplemental (i.e., can be omitted) collecting structure 16 configured for collecting grains adjacent the suction tubes 11 as the vacuum cleaner 20 operates to adsorb grains. The collecting structure 16 includes a fixing board 162 and a collecting board 164. The fixing board 162 is a plain board and can be fixed (e.g., welded) to the sidewall 144 of the accommodating room 14. In this case, the collecting board 164 combined with the fixing board 15 is located below the suction tubes 11. The collecting board 164 is a bent board. The collecting board 164 and the fixing board 162 cooperatively enclose a collecting space (not labeled) for collecting grains.

In use, each suction tube 11 passes by switching corresponding switch 112. As the vacuum cleaner 20 works, grains are adsorbed from the suction hoods 30 through the suction tubes 11 into the accommodating room 14. The adsorbed grains are further eject by the eject tube 12 from the accommodating room 14 through the eject tube 12 into the waste bin of the vacuum cleaner 20.

It is advantageous that, during operation, the plurality of suction tubes combined with the corresponding suction hoods can absorb various kinds of grains (e.g. grains with different size or shape) at various positions by the vacuum cleaner 20. In addition, as the vacuum cleaner operated, cool air is injected from the air supply via the air inlet into the eject tube and the vacuum cleaner. Airflow of the eject tube is thus increased. As such, possibility of grains blocking the eject tube can be reduced greatly and the air temperature of the eject tube is correspondingly lowered. A driving motor of the vacuum cleaner can then be cooled, which effectively maintains usage life of the driving motor.

It is to be understood, however, that even through numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A suction head structure, comprising:

a plurality of suction tubes, each of the plurality of suction tubes having a switch disposed thereon, each switch being configured for blocking or releasing of each suction tube;

an eject tube communicating with each of the plurality of suction tubes; and an air inlet communicating with the eject tube.

2. The suction head structure as claimed in claim 1, wherein the eject tube comprises a curve tube and a straight tube, the air inlet being disposed on a connecting portion of the curve tube and the straight tube.

3. The suction head structure as claimed in claim 2, wherein the air inlet linearly communicates with the straight tube.

4. The suction head structure as claimed in claim 2, further comprising an accommodating room, the accommodating room communicating with the suction tubes and the eject tube.

5. The suction head structure as claimed in claim 4, wherein the accommodating room is hollow three-dimensional trapezoid.

6. The suction head structure as claimed in claim 4, wherein the accommodating room comprises an upper wall, a lower wall, and at least one sidewall, the upper wall defines a connecting hole therethrough, the connecting hole communicating with the curve tube, one sidewall defining through holes corresponding to the suction tubes, and through holes respectively communicating with the suction tubes.

7. The suction head structure as claimed in claim 4, further comprising a fixing board, the fixing board being fixed to the accommodating room.

8. The suction head structure as claimed in claim 4, further comprising a collecting structure, the collecting structure being fixed to the accommodating room, and the collecting structure being configured for collecting grains.

9. A suction head structure used for adsorbing grains, comprising:

an accommodating room configured for accommodating grains therein;

a plurality of suction tubes connecting with the accommodating room, each of the plurality of suction tubes configured for adsorbing grain into the accommodating room, each of the plurality of suction tubes having a switch disposed thereon, each switch being configured for controlling pass or cut of each suction tube;

an eject tube communicating with the accommodating room, the eject tube configured for facilitating ejecting grains accommodated in the accommodating room; and an air inlet communicating with the eject tube, the air inlet configured for facilitating injecting cool air into the eject tube.

10. The suction head structure as claimed in claim 9, wherein the eject tube comprises a curve tube and a straight tube, the air inlet linearly communicating with the straight tube.

11. The suction head structure as claimed in claim 9, wherein the accommodating room is hollow three-dimensional trapezoid.

12. The suction head structure as claimed in claim 11, wherein the accommodating room comprises an upper wall, a lower wall, and at least one sidewall, the upper wall defining a connecting hole therethrough, the connecting hole communicating with the curve tube, one sidewall defining through holes corresponding to the suction tubes, and through holes respectively communicating with the suction tubes.

13. The suction head structure as claimed in claim 9, further comprising a fixing board, the fixing board being fixed to the accommodating room.

14. The suction head structure as claimed in claim 9, further comprising a collecting structure, the collecting structure being fixed to the accommodating room, and the collecting structure being configured for collecting grains.

15. A vacuum cleaner using a suction head structure for adsorbing grains, the vacuum cleaner comprising a plurality of suction hoods, the suction head structure comprising:

an accommodating room configured for accommodating grains therein;

a plurality of suction tubes communicating with the accommodating room, each of the plurality of suction tubes configured for adsorbing grain into the accommodating room, the suction tubes corresponding to the suction hoods, each suction hood communicating with respective suction tube each of the plurality of suction tubes having a switch disposed thereon, each switch being configured for blocking or releasing of each suction tube;

an eject tube connecting with the accommodating room, the eject tube configured for facilitating ejecting grains accommodated in the accommodating room; and an air inlet connecting with the eject tube, the air inlet configured for facilitating injecting cool air into the eject tube.

16. The vacuum cleaner as claimed in claim 15, wherein the eject tube comprises a curve tube and a straight tube, the air inlet linearly communicating with the straight tube.

17. The vacuum cleaner as claimed in claim 15, wherein the accommodating room comprises an upper wall, a lower wall, and at least one sidewall, the upper wall defines a connecting hole therethrough, the connecting hole communicating with the curve tube, one sidewall defining through holes corresponding to the suction tubes, and through holes respectively communicating with the suction tubes.

* * * * *